United States Patent [19]

Kemper

[11] 4,033,657

[45] July 5, 1977

[54] BUSS BARR

[75] Inventor: David C. Kemper, Mount Ephraim, N.J.

[73] Assignee: The Burdette Company, Mount Ephraim, N.J.

[22] Filed: Feb. 11, 1976

[21] Appl. No.: 656,998

[52] U.S. Cl. ..... 339/19; 339/22 B

[51] Int. Cl.[2] ..... H01R 11/22

[58] Field of Search ..... 339/19, 222, 22 B

[56] References Cited

UNITED STATES PATENTS

| | | | |
|---|---|---|---|
| 3,488,620 | 1/1970 | Sullivan et al. | 339/19 |
| 3,582,864 | 6/1971 | Sullivan | 339/19 |
| 3,609,634 | 9/1971 | Hovnanian | 339/19 |
| 3,951,497 | 4/1976 | Balzano et al. | 339/19 |

*Primary Examiner*—Francis S. Husar
*Assistant Examiner*—John McQuade
*Attorney, Agent, or Firm*—Frederick A. Zoda; Albert Sperry; John J. Kane

[57] ABSTRACT

A buss bar for electrically coupling a plurality of electrical terminal posts or wires including a generally tubular elongated body formed of electrical conducting material which defines a slot extending substantially along the entire lateral side of the body, a plurality of holes or apertures arranged in pairs such that one of the holes of each pair is positiond in the upper surface of the body and one of the holes of each pair is positioned in the lower surface of the body to allow one of the terminal posts to be positioned through each of the aperture pairs, a groove or other similar indentation along the opposite side of the body from the slot and extending inward into the center of the body such that the interior surface of the groove is in a position of abutment with a terminal post positioned through the upper and lower holes, the amount of lateral pressure exerted by this interior pressure exerting surface upon the terminal posts being variable proportionally in response to the width of the slot located on the opposite side of the terminal post, the electrical communication being provided by the electrical conducting material from which the body is made and by the secure and efficient electrical connection provided between the terminal post and the three points of contact which are the edges of the upper and lower holes and the pressure surface. The body may also have about the outer surface thereof a coating of electrical insulating material to minimize electrical contact with the surrounding environment.

12 Claims, 5 Drawing Figures

Fig. 1
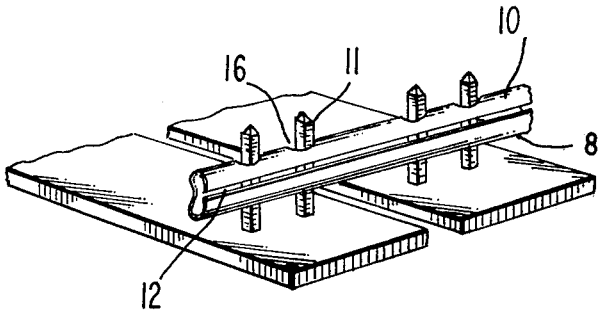
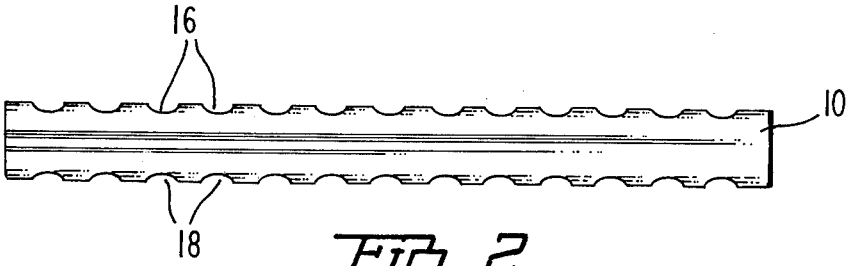
Fig. 2
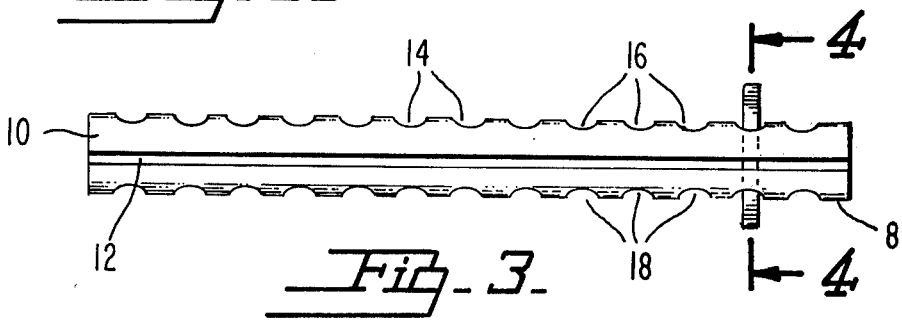
Fig. 3
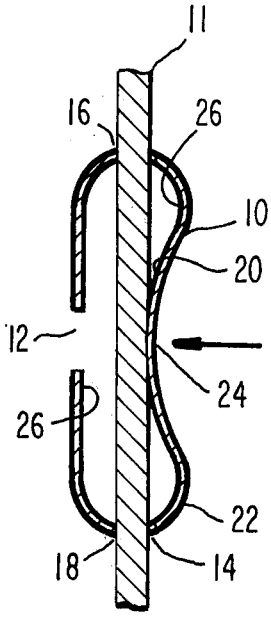
Fig. 4
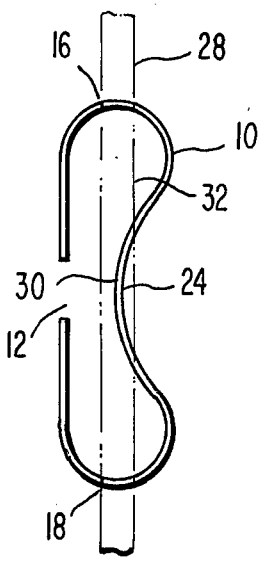
Fig. 5

BUSS BARR

BACKGROUND OF THE INVENTION

1. Field of the Invention

This invention relates to electrical connectors and particularly to electrically continuous buss bar assemblies. In many fields of electrical art, it is desirable to provide electrical connection between adjacently positioned terminal posts or pins which has insignificant or negligible resistance. Such devices are commonly employed in computors, communication systems, solid state wiring connections, circuit boards, and terminal blocks.

To achieve electrical connection between the terminal post is often desirable to place a buss trip or buss bar between the terminals which is securely fastened thereto and provides a good electrical contact therewith. Such assemblies are common in the electrical connecting field of art and numerous configurations have been developed heretofor.

2. Description of the Prior Art

An electrical connecting strip or buss bar must be constructed to allow placement of the strip between electrical terminals in a simple one-step operation. Also, in large electrical assemblies a large number of such buss bars and the like are utilized so that minimization of part cost and speed of assembly are essential elements to take into consideration in the construction of metallic strip connectors. Also, since connection with minimal resistance is required, the material from which buss connectors are formed is usually one of the expensive metals such as copper or alloys thereof. U.S. Pat. No. 3,668,606 issued June 6, 1972 and U.S. Pat. No. 2,273,099 issued Feb. 17, 1942 are two examples of electrical connector strips which are formed of flat sheet material which are easy to install and require the minimum amount of metallic connector material. Both of these designs are capable of being formed from thin flat sheets of metal. Although there are distinct cost advantages with these two designs, a problem exists due to the minimum amount of contact surface between the connector and the terminal posts.

To improve contact between the terminal posts and the buss bar, constructions have been designed such as U.S. Pat. Nos. 3,829,818 and 3,868,163 in which multiple points of contact exist between the terminal posts and the buss bar itself. Other designs showing multiple contact between the individual terminal posts and the electrical connector are shown in U.S. Pat. Nos. 3,582,864, 3,665,600, and 3,488,620. Each of these patents shows a different configuration designed to minimize the amount of material needed for forming the buss bar while at the same time maximizing contact between the terminal posts and the buss bar itself. To maximize the contact, there must be a lateral biasing exerted by the buss bar itself between its contacting points and the terminal posts itself. However, it is desirable to utilize a buss strip design which is capable of usage with terminal posts of variable designs and spacings. In this respect, the amount of lateral pressure exerted by the buss bar upon the terminal posts must be variable and controllable. To vary the pressure exert by the contacting surface of the buss strip and the terminal post itself with the configurations of the above patents, it is necessary to deform the buss bar substantially. As such, it is desirable to provide a buss bar which provides a means for easily controlling the variation in pressure exerted by the buss bar along the surfaces contacting the terminal posts and providing electrical communication therewith.

SUMMARY OF THE INVENTION

The present invention is a buss bar which may be adjustable to be utilized for providing electrical communication between a plurality of electrical terminal posts or pins. The buss bar includes a generally tubular body of an elongated configuration formed of an electrically conductive material. The cylindrical body includes a slot extending laterally along one side of the tubular body to run along an axis parallel to the axis of the generally tubular body. Within the body is formed a plurality of aperture pairs positioned with one of each pair of apertures in the top section of the body and one of each pair of apertures in the bottom section of the body such that a terminal post may pass through the body and be in contact with the buss bar by passing through both apertures of one pair of apertures.

When a terminal post is positioned passing through a set of apertures, the upper hole and the lower hole may provide two points of contact between the terminal posts and the buss bar. Preferably a biasing device such as a pressure surface will extend into the center of the body to urge the terminal post into secure abutment with the upper and lower holes and to achieve good electrical contact therewith while at the same time securing good electrical contact by abutment with the pressure surface. To form the biasing device, a groove may be formed in the side of the body located on the opposite side of the body from the slot. In this configuration the interior surface of the groove will form the pressure surface and will exert a bias upon a terminal post which is passed through the upper and lower holes to provide secure electrical contact between the terminal posts and the buss bar at the three locations of abutment therewith.

With this design the amount of pressure exerted by the pressure surface will vary proportionally to the positioning of the pressure surface within the body of the buss bar. In particular, if the width of the slot is increased the bias exerted laterally upon the terminal posts by the pressure surface will increase to achieve the desired contact pressure in consideration of the size and configuration of the terminal posts with which the buss bar is presently being utilized.

It is an object of the present invention to provide an easily adjustable buss bar to effect electrical communication between variably placed and configured terminal post assemblies.

It is an object of the present invention to provide a buss bar assembly which may be detachably engaged with terminal post configurations to allow repeated use of the same buss bar.

It is an object of the present invention to provide a buss bar assembly which uses a minimum amount of electrically conductive material to thereby achieve cost savings.

It is an object of the present invention to provide a buss bar assembly which includes a plurality of contacting surfaces between the buss bar and the terminal posts to minimize contact resistance.

It is an object of the present invention to provide a buss bar assembly of minimal electrical resistance.

It is an object of the present invention to provide a buss bar assembly which requires a single simple placement operation.

It is an object of the present invention to provide a buss bar assembly which minimizes the chances of shorting with peripheral electrical equipment.

It is an object of the present invention to provide a buss bar assembly which can be preset for a specific pressure when used with a specific size terminal post prior to placement.

BRIEF DESCRIPTION OF THE DRAWINGS

While the invention is particularly pointed out and distinctly claimed in the concluding portions therein, a preferred embodiment is set forth in the following detailed description which may be best understood when read in connection with the accompanying drawings in which:

FIG. 1 is a perspective view showing an embodiment of the present invention in position electrically connecting a plurality of terminal posts;

FIG. 2 is a front elevation of an embodiment of the present invention;

FIG. 3 is a rear elevation view of an embodiment of the present invention;

FIG. 4 is a cross-sectional view of the embodiment shown in FIG. 3 taken through lines 4—4; and FIG. 5 is a cross-sectional view of another embodiment of the present invention in the relaxed position.

DETAILED DESCRIPTION OF THE PREFERRED EMBODIMENT

An embodiment of the present invention as shown in FIG. 1 includes a plurality of terminal posts 11 which are electrically connected by the body 10 of buss bar 8. A slot 12 extends longitudinally along one side of the body 10 and a plurality of pairs of apertures 14 are positioned along the body in the form of upper holes 16 and lower holes 18. On the opposite side of the body from slot 12 may be positioned a groove 24, the inner surface of which presents a pressure surface for urging terminal posts 11 laterally to secure full electrical contact between the terminal posts 11 and the buss bar 8. To further enhance the conductive properties of the body 10 of the buss bar 8 a conductive coating 26 may be placed upon the body 10 of the buss bar to maximize electrical flow through the buss bar and minimize electrical resistance thereof. Also, an insulating material such as Mylar or the like may be used as a coating 22 to minimize the possibilities of undesirable electrical communication between the buss bar 8 or the terminal posts 11 with surrounding peripheral electrical equipment.

Many electrical devices make use of a plurality of adjacently spaced terminal posts such as shown generally as posts 11. Such devices include circuit board configurations and solid state devices. Often, the electrical characteristics of the devices are extremely critical since, in particular, solid state devices will operate often at very low current voltage levels. With such devices the criticality of resistance in measurements is extremely high. In such devices any buss bars utilized therewith must provide electrical communication between the terminal posts at an absolute minimum resistance. The choice of material from which to form buss bars and similar terminal connectors is a very important characteristic and similarly the resistance of the contact points between the buss bars and the terminal posts is equally important. One of the primary factors in determining this contact resistance is the amount of pressure exerted between the contacting surfaces. With this element of criticality in mind, the present invention provides a means for closely controlling the pressure exerted at the contact points between the buss bars and the terminal posts. In addition, this very critical adjustment may be made prior to placement of the buss bar upon the terminal posts.

The buss bar of the present invention has a generally tubular shaped body 10. The terminal posts 11 are adapted to pass through the holes 16 and 18 such that they will be approximately perpendicular to the axis of the tubular body 10. Without any auxiliary biasing means, contact between the terminal posts 11 and the buss bar 8 will solely be determined by the relative orientation between upper hole 16 and lower hole 18. To achieve increased contact between the buss bar 8 and the terminal post 11 a lateral biasing means such as pressure surface 20 is shown in the embodiment of FIG. 4. While the exertion of lateral bias is desirable to improve electrical contact between the buss bar and the terminal post, a new element of criticality is introduced since the relative orientation of holes 16 and 18 and pressure surface 20 is now an important and critical design characteristic.

FIG. 5 shows an end cross-sectional view of the body of the buss bar of the present invention in which a terminal post is not positioned therethrough. As such, the buss bar shown in FIG. 5 is in a relaxed state. Shown in dotted lines 28 is the projected position of a buss bar extending through the upper and lower holes. As shown in FIG. 5, the critical distance for measuring the lateral bias or pressure exerted by pressure surface 20 upon terminal post 11 is the distance between the apex 30 of pressure surface 20 and the abutment side 32 of the projected terminal post 28. In particular, as this distance is made greater the amount of lateral pressure which will be exerted upon terminal post 11 when placed within upper and lower holes 16 and 18 will be made greater. The amount of bias exerted upon the terminal post 11 by the buss bar 8 will be directly proportional to the displacement of groove 24 inwardly toward the center of generally tubular body 10.

An important characteristic of the present invention is the capability to vary this lateral pressure while still maintaining three full contacting points between the post 11 and the buss bar 8.

The width of slot 12 is extremely critical when considering the contacting pressure between the post and the buss bar. If the slot 12 is made wider the upper and lower holes 16 and 18 will be slightly displaced to the right while at the same time the inner surface of pressure surface 20 of groove 24 will be slightly displaced to the left as shown in FIG. 4 such that the pressure exerted between the apex 30 of pressure surface 20 and abutment side 32 of terminal post 28 will be made greater.

In operation, two factors will determine the amount of pressure exerted laterally by pressure surface 20. Firstly, the size and configuration of terminal post 11 will be important. Considering a predetermined terminal post configuration, a standard conversion table will give the desired slot width which is required in order to exert a certain number of grams of force. For example, when working with a standard predetermined terminal size, an installation person will know that by setting the width of slot 12 at fifty thousandths of an inch (0.050 inches) the lateral pressure exerted upon the terminal post 11 by surface 20 will be 25 grams. Similarly, the installation person will have information at his disposal that by setting the slot width at a hundred thousandths (0.100 inches), the laterally exerted pressure exerted by pressure surface 20 will be 25 grams. In this manner by proportional adjustment between fifth thousandths and a hundred thousandths, any desirable pressure between 3 and 25 grams will be achievable.

One of the primary advantages of the present system is the capability to predetermine the lateral pressure prior to placement of the buss bar on the terminal posts. This capability decreases unit assembly time and increases the reliability of the adjustment of the final configuration. To increase the conductive flow of the body 10 and to decrease the resistance to electrical flow therein an additional layer of highly conductive material such as gold or the like can be placed selectively on portions of the surface of the body 10. As shown in FIG. 4 this highly conductive layer may be placed as a coating on the inner surface of the tubular body 10. Similarly an electrically insulating coating to minimize electrical communication with surrounding equipment may be placed on portions of the surface of the body 10 of the buss bar 8 such as a coating of plastic material or the like as shown in FIG. 4 as coating 22.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed therein are intended to be illustrative only and not intended to limit the scope of the invention.

I claim:

1. For use with a plurality of electrical terminal posts, a buss bar comprising:

a. an elongated generally tubular body of electrically conducting material, said body defining a slot extending laterally along a side thereof;

b. said body defining a plurality of pairs of apertures, each pair of apertures including an upper hole positioned in the upper portion of said body and a lower hole position in the lower portion of said body, each of said pairs of apertures being adapted to receive therethrough an electrical terminal post to provide electrical communication between posts positioned within each pair of apertures; and c. a pressure surface on said body extending toward the center of said body to be in abutment with the terminal posts positioned extending through the pairs of said upper and lower holes, said pressure surface adapted to laterally bias the terminal posts into full electrical contact with edges of said upper and lower holes and with said pressure surface.

2. The buss bar as defined in claim 1 wherein said slot and said pressure surface are positioned at opposite sides of said body.

3. The buss bar as defined in claim 1 wherein said body is formed of a resilient deformable material to allow the width of said slot to be variable.

4. The buss bar as defined in claim 3 wherein variation of the width of said slot controls the amount of pressure exerted upon the terminal posts by said pressure surface.

5. The buss bar as defined in claim 3 wherein the width of said slot is proportioned to the distance which said pressure surface extends into the interior of said body.

6. The buss bar as defined in claim 1 wherein said pressure surface is responsive to an increase in the width of said slot to increase the pressure exerted laterally on the terminal posts.

7. The buss bar as defined in claim 1 wherein said body includes a coating of insulating material upon portions of the surfaces thereof.

8. The buss bar as defined in claim 7 wherein said coating is a plastic material.

9. The buss bar as defined in claim 1 wherein said body includes a groove extending laterally along one side thereof, the interior surface of said groove acting as said pressure surface by abutting the terminal posts.

10. The buss bar as defined in claim 1 further including a coating of electrically conducting material on said body.

11. The buss bar as defined in claim 10 wherein said coating is gold.

12. For use with a plurality of electrical terminal posts, a buss bar comprising:

a. an elongated tubular body of electrical conducting material, said body defining a slot extending laterally along a side thereof, said slot having a variable width;

b. said body defining a plurality of pairs of apertures, each pair of apertures including an upper hole defined by the upper portion of said body and a lower hole defined by the lower portion of said body, each of said pairs of apertures being adapted to receive therethrough an electrical terminal post to provide electrical communication between the posts positioned within each pair of apertures;

c. a pressure surface on said body positioned on the opposite side of the terminal posts from said slot and extending toward the center of said body to be in abutment with the terminal posts positioned extending through each pair of said upper and lower holes, said pressure surface adapted to bias laterally a terminal post into full electrical contact with edges of said upper and lower holes, said surface adapted to exert variable lateral bias in proportion to the adjusted width of said slot;

d. an electrically insulating coating on the outer surface of said body; and e. an electrically conductive coating on the inner surface of said body.

* * * * *